US006092842A

United States Patent [19]

Arway et al.

[11] Patent Number: 6,092,842

[45] Date of Patent: Jul. 25, 2000

[54] SHIPMENT FORM

[75] Inventors: Lawrence W. Arway, Dayton; David F. Laurash, Bellbrook, both of Ohio; Thomas M. Chase, North Bend, Wash.; Richard F. Case, Bellevue, Wash.; Lisa A. Huffstutter, Issaquah, Wash.

[73] Assignee: The Standard Register Company, Dayton, Ohio

[21] Appl. No.: 09/248,537

[22] Filed: Feb. 11, 1999

Related U.S. Application Data

[60] Provisional application No. 60/093,154, Jul. 17, 1998.

[51] Int. Cl.[7] ..... B42D 15/00

[52] U.S. Cl. ..... 283/80; 283/79; 283/80; 283/81; 462/22; 462/24; 462/28; 462/39

[58] Field of Search ..... 283/80, 81, 79; 462/22, 24, 28, 39

[56] References Cited

U.S. PATENT DOCUMENTS

| | | | |
|---|---|---|---|
| 1,984,559 | 12/1934 | Wilcox | 229/74 |
| 2,305,426 | 12/1942 | Howell | 229/74 |
| 4,216,598 | 8/1980 | Newbert | 40/331 |
| 4,240,543 | 12/1980 | McKee | 206/39 |
| 4,460,119 | 7/1984 | Goodfellow et al. | 229/68 R |
| 4,462,538 | 7/1984 | Gendron | 229/68 R |
| 4,545,521 | 10/1985 | Hiersteiner | 229/68 R |
| 4,749,432 | 6/1988 | Ando et al. | 156/257 |
| 4,995,642 | 2/1991 | Juszak et al. | 283/79 |
| 5,282,649 | 2/1994 | William et al. | 283/56 |
| 5,299,979 | 4/1994 | Ballard | 462/18 |
| 5,383,686 | 1/1995 | Laurash | 283/81 |
| 5,458,282 | 10/1995 | Martin | 229/92.8 |
| 5,807,623 | 9/1998 | Chess | 283/81 |

*Primary Examiner*—Willmon Fridie, Jr.
*Assistant Examiner*—Daniel Phan
*Attorney, Agent, or Firm*—Killworth, Gottman, Hagan & Schaeff LLP

[57] ABSTRACT

This need is met by the present invention wherein an improved shipment form is provided comprising a partially releasable liner ply, a peel-out package label portion, and a peel-out signature tab. In accordance with one embodiment of the present invention, a shipment form is provided comprising a face sheet, a liner ply, and an adhesive interposed between the face sheet and the liner ply. The face sheet includes printed indicia for indicating an attempted delivery. The adhesive includes a laminating adhesive portion and a reusable adhesive portion. The liner ply defines a releasable liner ply portion adjoining a laminated liner ply portion. The releasable liner ply portion is configured to releasably adhere to the reusable adhesive portion while remaining adjoined to the laminated liner ply portion. The reusable adhesive portion and the releasable liner ply portion are configured such that the reusable adhesive portion retains its properties of adhesion following release of the releasable liner ply portion therefrom. The laminated liner ply portion is configured to adhere to the laminating adhesive portion with an adhesion strength substantially greater than an adhesion strength of the releasable liner ply portion to the reusable adhesive portion.

21 Claims, 4 Drawing Sheets

SHIPMENT FORM

CROSS REFERENCE TO RELATED APPLICATIONS

This application claims the benefit of U.S. Provisional Application No. 60/093,154 filed Jul. 17, 1998.

BACKGROUND OF THE INVENTION

The present invention relates to shipment forms and, more particularly, to a multifunction business form for indicating an attempted delivery, identifying a package for which delivery has been attempted, and authorizing delivery or pick-up of a package. The business form of the present invention is also directed to informing an intended recipient of conditions for delivery.

Package delivery services are continuously confronted with the problems associated with undeliverable packages—packages which cannot be delivered because no one is available to accept delivery. In general, the package must either be left at the delivery address or returned to the delivery station. In either case, there must be some documentation of the attempted delivery.

Conventional attempted delivery notices typically comprise a form with some type of releasable or temporary adhesive provided thereon. The form describes the circumstances of the delivery and is adhered on a door, window, or other conspicuous surface at the delivery address. These conventional forms have inherent functional limitations and have achieved limited commercial success in the package delivery business. Accordingly, there is a need for an attempted delivery notice or shipment form that provides an improved means for indicating an attempted delivery and a number of additional functions not available with conventional business forms.

BRIEF SUMMARY OF THE INVENTION

This need is met by the present invention wherein an improved shipment form is provided comprising a partially releasable liner ply, a peel-out package label portion, and a peel-out signature tab.

In accordance with one embodiment of the present invention, a shipment form is provided comprising a face sheet, a liner ply, and an adhesive interposed between the face sheet and the liner ply. The face sheet includes printed indicia for indicating an attempted delivery. The adhesive includes a laminating adhesive portion and a reusable adhesive portion. The liner ply defines a releasable liner ply portion adjoining a laminated liner ply portion. The releasable liner ply portion is configured to releasably adhere to the reusable adhesive portion while remaining adjoined to the laminated liner ply portion. The reusable adhesive portion and the releasable liner ply portion are configured such that the reusable adhesive portion retains its properties of adhesion following release of the releasable liner ply portion therefrom. The laminated liner ply portion is configured to adhere to the laminating adhesive portion with an adhesion strength substantially greater than an adhesion strength of the releasable liner ply portion to the reusable adhesive portion.

Preferably, the reusable adhesive portion is arranged to define an adhesion surface that is capable of supporting the weight of the shipment form when secured to a substantially vertical mounting surface. The liner ply may be structurally altered to define a bendable portion positioned proximate a boundary defined between the releasable liner ply portion and the laminated liner ply portion. The bendable portion may comprise a perforation provided in the liner ply. The perforation may be offset from a boundary between the releasable liner ply portion and the laminated liner ply portion.

The face sheet, the adhesive, and the releasable liner ply portion may include respective cut-out portions formed therein, wherein the respective cut-out portions are arranged to define a form hanging aperture. The shipment form may further comprise a die cut extending entirely through the cross section of the form from a side edge of the form to the form hanging aperture. The form may be configured to define a peel back tab portion in the liner ply.

The releasable liner ply portion and the laminated liner ply portion preferably define a continuous planar surface of the liner ply. The reusable adhesive portion and the laminating adhesive portion are preferably comprised of a common adhesive composition and are defined by a single continuous adhesive layer. Further, the liner ply and the adhesive preferably extend substantially the entire length of the face sheet. The shipment form may be arranged to define first and second continuous external surfaces, wherein the first continuous external surface is defined by substantially all of the face sheet, and wherein the second continuous external surface is defined by substantially all of the liner ply.

In accordance with another embodiment of the present invention, a shipment form is provided comprising a face sheet, a liner ply, an adhesive interposed between the face sheet and the liner ply, and a peel-out package label formed in the face sheet. The face sheet defines an upper face sheet surface and a lower face sheet surface. The liner ply defines an upper liner ply surface and a lower liner ply surface. The peel-out package label defines an upper package label surface and a lower package label surface. The upper package label surface is substantially co-planar with the upper face sheet surface. The lower package label surface is substantially co-planar with the lower face sheet surface. The peel-out package label includes printed indicia on the upper package label surface for indicating an attempted delivery. The lower package label surface includes a CB solution coated thereon. The upper liner ply surface includes a CF solution coated thereon. The CF coating on the upper liner ply surface is positioned in registration with the CB coating on the lower package label surface. The adhesive is configured to include (i) an adhesive void positioned in registration with the CF coating and the CB coating and (ii) a secondary reusable adhesive portion. The liner ply, the peel-out package label, and the secondary reusable adhesive portion are configured such that, following release of the peel-out package label from the liner ply, the secondary reusable adhesive portion releases substantially cleanly from the liner ply and retains its properties of adhesion.

The secondary reusable adhesive portion may be arranged about a periphery of the peel-out package label and the adhesive void is at least partially bounded by the secondary reusable adhesive portion. The peel-out package label may include printed indicia instructing a user of the shipment form to remove the peel-out package label from the shipment form and adhere the peel-out package label to a package. The adhesive void, the CF coating, and the CB coating are preferably configured to (i) permit a user of the shipment form to indicate on the upper peel-out package label surface conditions of an attempted delivery and (ii) enable simultaneous creation of a duplicate image of the attempted delivery conditions on the upper liner ply surface. The upper face sheet surface may define a front side of the shipment form and the lower liner ply surface may define a back side of the shipment form.

In accordance with yet another embodiment of the present invention, a shipment form comprising a face sheet, a liner ply, an adhesive interposed between the face sheet and the liner ply, and a peel-out signature label formed in the face sheet. The peel-out signature label defines an upper signature label surface and a lower signature label surface. The upper signature label surface is substantially co-planar with the upper face sheet surface. The lower signature label surface is substantially co-planar with the lower face sheet surface. The signature label is configured to permit a user of the shipment form to present an authorizing signature on the upper signature label surface. The upper face sheet surface includes a first set of printed indicia arranged to enable a user of the shipment form to indicate that the authorizing signature corresponds to an authorization to deliver a package. The upper face sheet surface includes a second set of printed indicia arranged to enable a user of the shipment form to indicate that the authorizing signature corresponds to an authorization to pick up a package. The adhesive is configured to include a signature label reusable adhesive portion. The liner ply, the peel-out signature label, and the signature label reusable adhesive portion are configured such that, following release of the peel-out signature label from the liner ply, the signature label reusable adhesive portion releases substantially cleanly from the liner ply and retains its properties of adhesion. Preferably, the adhesive portion covers substantially all of the lower signature label surface and the upper face sheet surface defines a front side of the shipment form and the lower liner ply surface defines a back side of the shipment form.

Accordingly, it is an object of the present invention to provide an improved shipment form for indicating an attempted delivery, providing an accurate means for tracking deliveries, and providing a means for authorizing pick-up or delivery of a shipment. Other objects of the present invention will be apparent in light of the description of the invention embodied herein.

BRIEF DESCRIPTION OF THE SEVERAL VIEWS OF THE DRAWINGS

The following detailed description of the preferred embodiments of the present invention can be best understood when read in conjunction with the following drawings, where like structure is indicated with like reference numerals and in which.

DETAILED DESCRIPTION OF THE PREFERRED EMBODIMENTS

Figure 1:
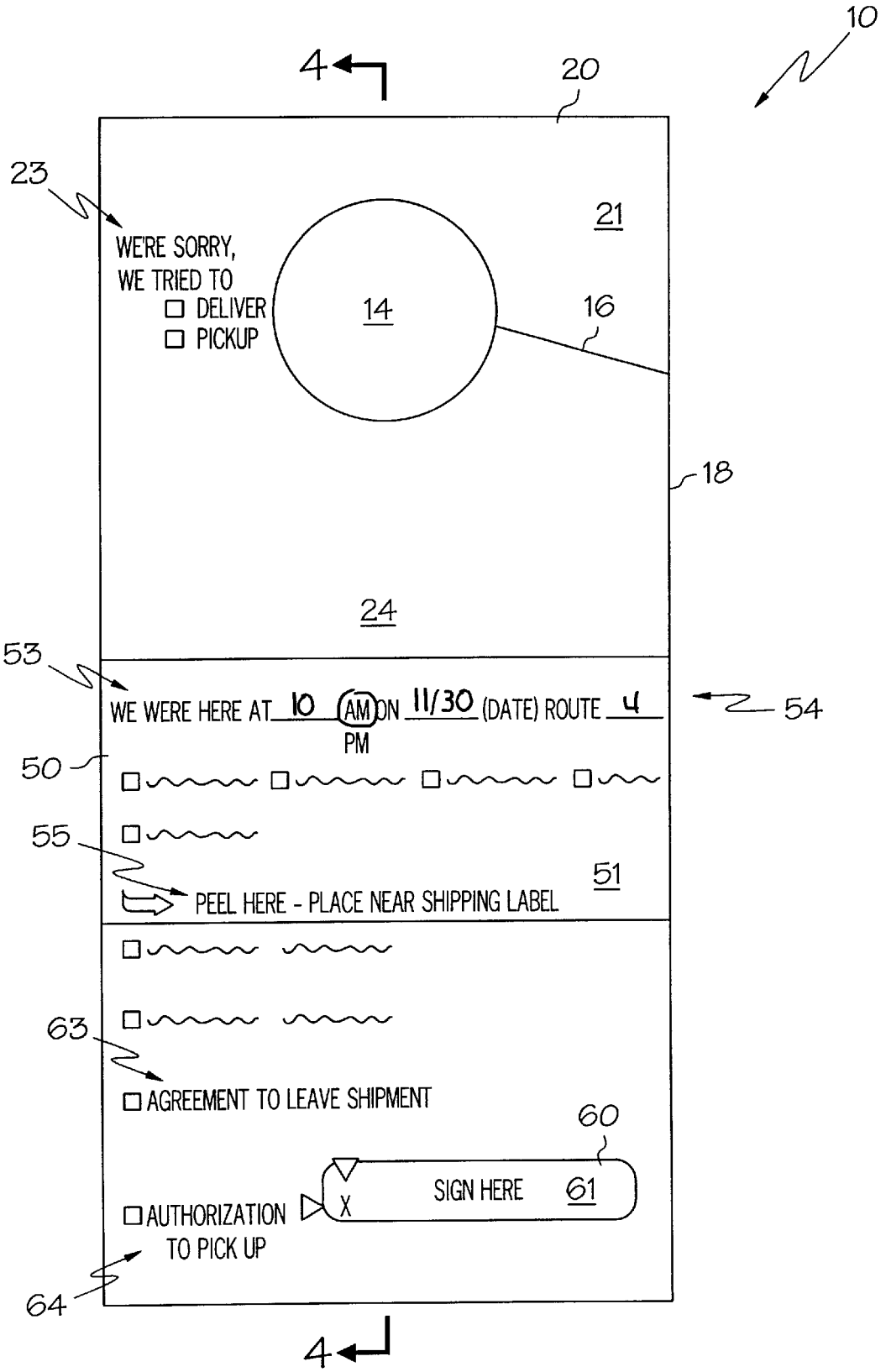
FIGS. 1 and 2 are front and back views, respectively, of a shipment form according to the present invention.
Figure 2:
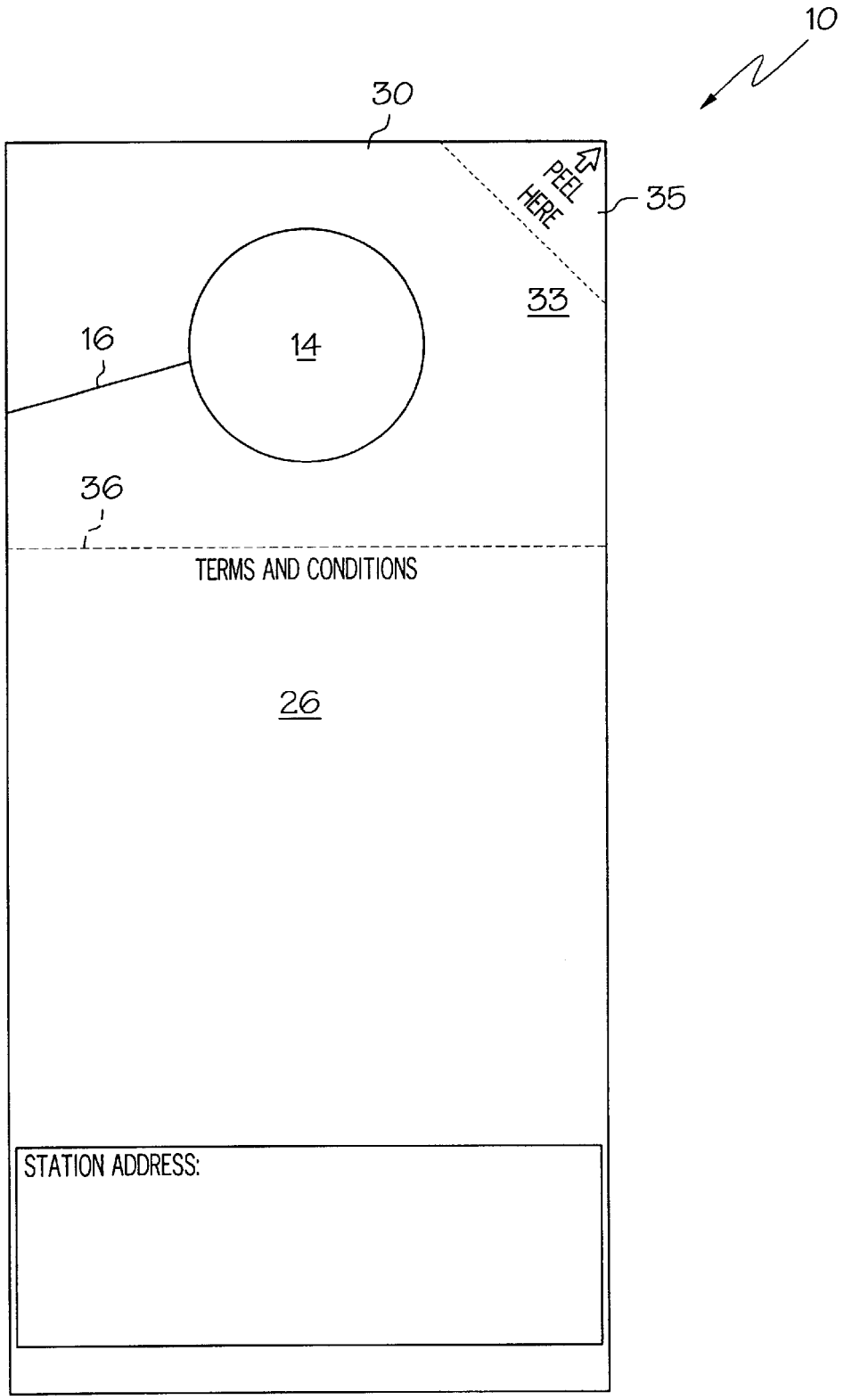

The nature of the present invention is described herein with reference to FIGS. 1–4, where an example of a shipment form 10 according to the present invention is illustrated. The shipment form 10 comprises a face sheet 20, a liner ply 30, and an 40 includes a reusable adhesive portion 42 and a laminating adhesive portion 44. It is contemplated by the present invention that the adhesive 40 may comprise a single type of adhesive or different types of adhesive in different portions thereof. For example, the reusable adhesive portion 42 may comprise a removable adhesive and the laminating adhesive portion 44 may comprise a permanent adhesive.

The face sheet 20 defines an upper face sheet surface 21 and a lower face sheet surface 22 and includes printed indicia 23 for indicating an attempted delivery, e.g., "We're Sorry, We Tried to Deliver a Shipment of. . . "

The liner ply 30 includes a base ply 37 and a patterned adhesive release layer 39. The liner ply 30 defines an upper liner ply surface 31, a lower liner ply surface 33, and a releasable liner ply portion 32 adjoining a laminated liner ply portion 34. The releasable liner ply portion 32 is configured to releasably adhere to the reusable adhesive portion 42 while remaining adjoined to the laminated liner ply portion 34. A peel back tab portion 35 is defined in the liner ply 30. Further, the reusable adhesive portion 42 and the releasable liner ply portion 32 are configured such that the reusable adhesive portion 42 retains its properties of adhesion following release of the releasable liner ply portion 32 therefrom. Finally, the laminated liner ply portion 34 is configured to adhere to the laminating adhesive portion 44 with an adhesion strength substantially greater than an adhesion strength of the releasable liner ply portion 32 to the reusable adhesive portion 42. The reusable adhesive portion 42 is arranged to define an adhesion surface that is capable of supporting the weight of the shipment form 10 when secured to a substantially vertical mounting surface.

A shipment form 10 constructed in the manner described above embodies significant functional assets. Specifically, the shipment form 10 encourages separation of the releasable liner ply portion 32 from the reusable adhesive portion 42 while preventing inadvertent separation of the laminated liner ply portion 34 from the laminating adhesive portion 44. In this manner, the reusable adhesive portion 42 may be conveniently and exclusively exposed and adhered to a mounting surface. Further, the releasable liner ply portion 32 need not be discarded upon separation from the reusable adhesive portion 42 because it remains adjoined to the laminated liner ply portion 34.

The liner ply 30 is configured to define a bendable perforated portion 36 positioned proximate a boundary 38 defined between the releasable liner ply portion 32 and the laminated liner ply portion 34. In the illustrated embodiment, the perforation 36 is offset slightly from the boundary 38 between the releasable liner ply portion 32 and the laminated liner ply portion 34. The provision of the bendable perforated portion 36 helps ensure that, upon separation of the releasable liner ply portion 32 from the reusable adhesive portion 42, the releasable liner ply portion 32 is inclined to hang down or bend towards the laminated liner ply portion 34 so as not to interfere with an intended adhesion of the reusable adhesive portion 42 with a mounting surface.

In the illustrated embodiment, the face sheet 20, the adhesive 40, and the releasable liner ply portion 32 include respective cut-out portions 12 formed therein. The respective cut-out portions 12 are arranged to define a form hanging aperture 14. A die cut 16 extends entirely through the cross section of the shipment form 10 from a side edge 18 of the form 10 to the form hanging aperture 14. The die cut 16 and the form hanging aperture 14 are arranged to enable a user to hang the form 10 from a conventional door knob. For the purposes of defining and describing the present invention, it is noted that a user of a shipment form includes but is not limited to a person charged with the delivery or pick-up of a package.

The releasable liner ply portion 32 and the laminated liner ply portion 34 define a continuous planar surface of the liner ply 30. Similarly, the reusable adhesive portion 42 and the laminating adhesive portion 44 are comprised of a common adhesive composition and are defined by a single substantially continuous adhesive layer. Although the adhesive layer is referred to herein as a "substantially" continuous layer, as will be appreciated by those practicing the present invention, the adhesive layer does include the cut-out portion 12 described above. The liner ply 30 and the adhesive 40 extend substantially the entire length of the face sheet 20.

The shipment form 10 is arranged to define first and second substantially continuous external surfaces 24, 26. Although the external surfaces 24, 26 are referred to herein as a "substantially" continuous surfaces, as will be appreciated by those practicing the present invention, the surfaces do include the cut-out portion 12 described above. The first continuous external surface 24 is defined by the face sheet 20. The second continuous external surface 26 is defined by the liner ply 30.

The shipment form 10 of the present invention also includes a peel-out package label 50 formed in the face sheet 20. The peel-out package label 50 defines an upper package label surface 51 and a lower package label surface 52. The upper package label surface 51 is substantially co-planar with the upper face sheet surface 21. The lower package label surface 52 is substantially co-planar with the lower face sheet surface 22. The peel-out package label 50 includes printed indicia 53 on the upper package label surface 51 for indicating an attempted delivery, e.g., "We were here at . . . AM/PM on . . . We could not leave your shipment because. . . "

Figure 3:
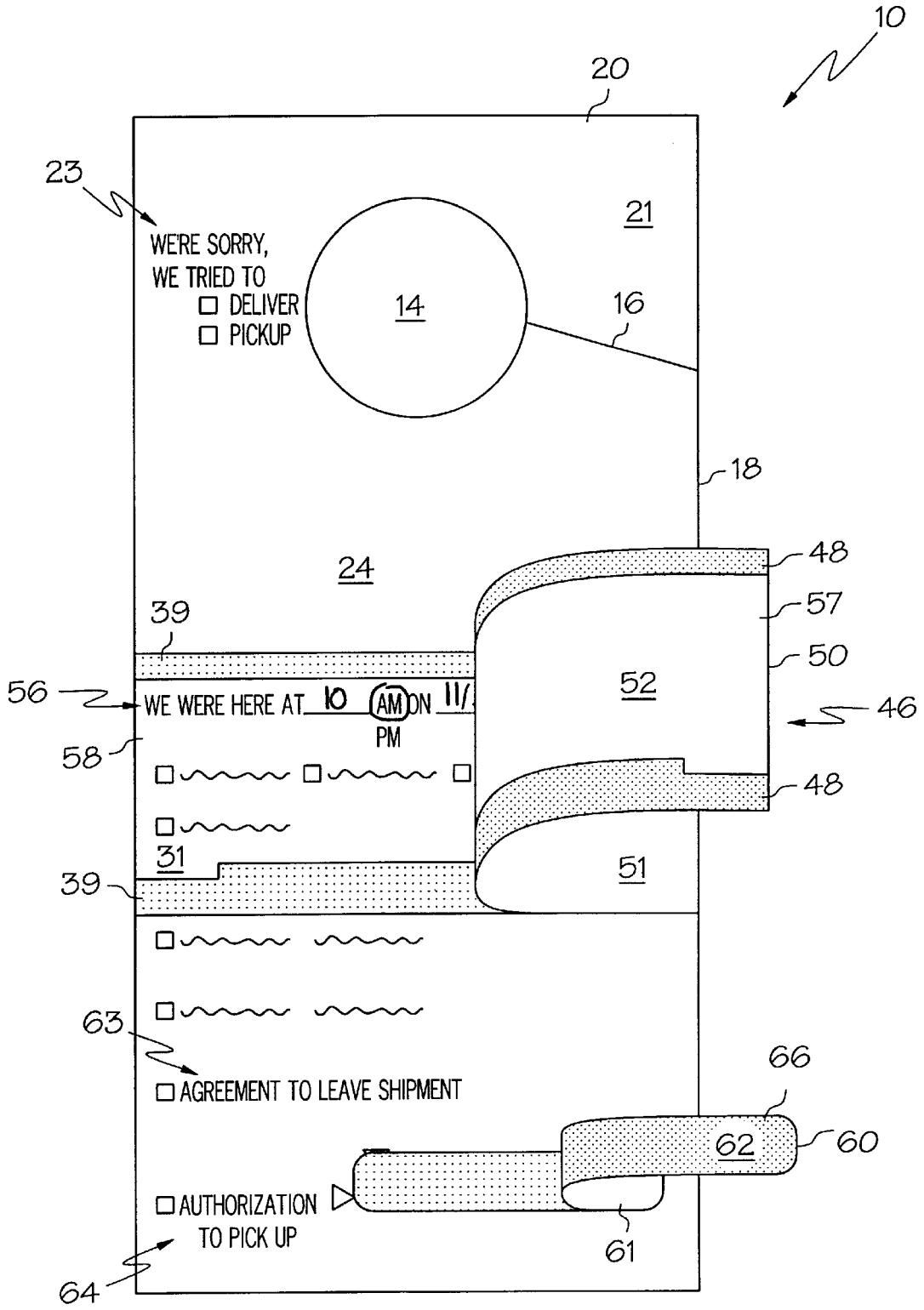
FIG. 3 is a front view of a shipment form according to the present invention where respective label portions thereof are illustrated in a partially peeled-back state.
Figure 4:
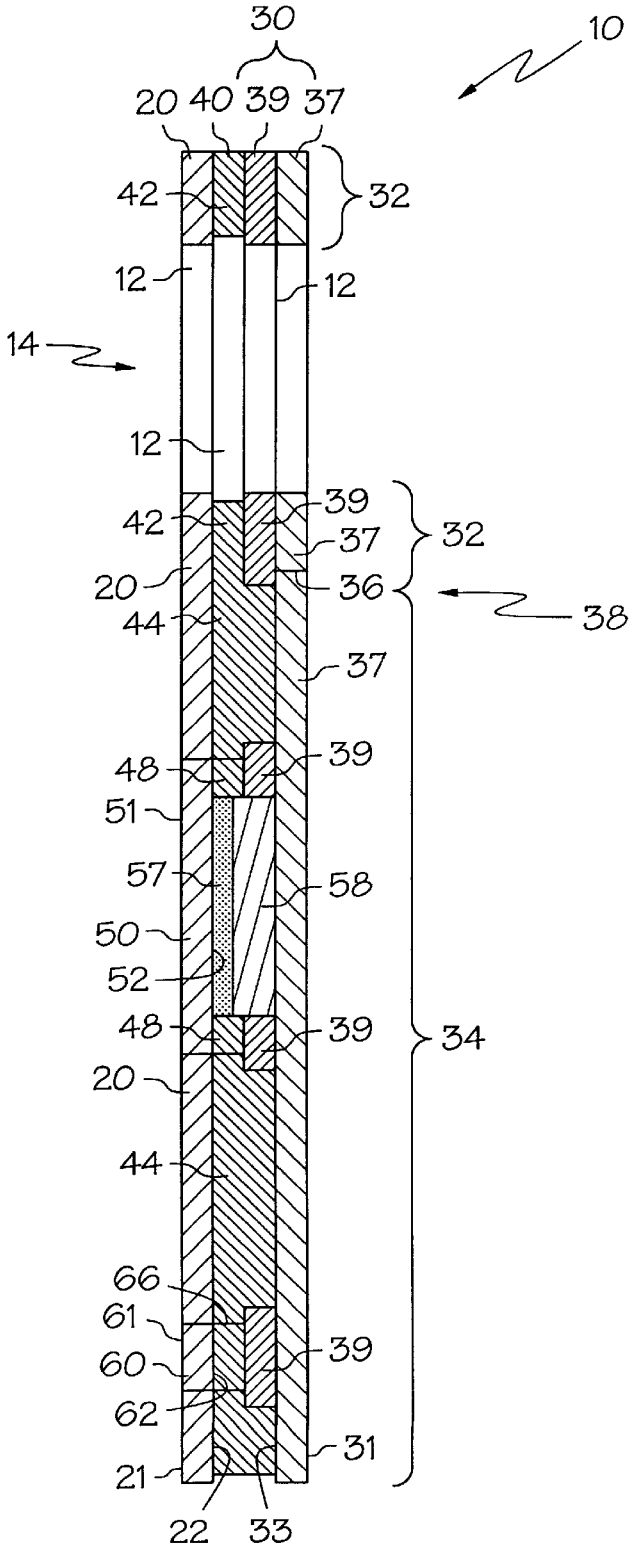
FIG. 4 is a schematic cross-sectional illustration of a shipment form according to the present invention.

The lower package label surface 52 includes a CB solution 57 coated thereon and the upper liner ply surface 31 includes a CF solution 58 coated thereon (See FIGS. 3 and 4). As will be appreciated by those skilled in the art, CB and CF refer to commercially available carbonless back (CB) and carbonless front (CF) coatings. The CF coating 58 on the upper liner ply surface 31 is positioned in registration with the CB coating 57 on the lower package label surface 52. As will be appreciated by those practicing the present invention, the CB and CF coatings 57, 58 complement each other such that, when physical impressions are made on a surface having a CB coated back, a duplicate image is created on the underlying surface coated with the CF solution. In this manner, impressions made through printing on the upper package label surface 51 are duplicated on the upper liner ply surface 31. More specifically, the CF coating 58 and the CB coating 57 are configured to (i) permit a user of the shipment form 10 to indicate on the upper peel-out package label surface 51 conditions of an attempted delivery 54 and (ii) enable simultaneous creation of a duplicate image 56 of the attempted delivery conditions on the upper liner ply surface 31.

The present invention is not limited to specific CB and CF compositions. Rather, any compositions functioning in this manner or in a substantially equivalent manner are contemplated by the present invention. An example of contemplated equivalent structure is illustrated in the case where the CF and CB coatings would be replaced with a single self contained carbonless coating on one of the two surfaces at issue. For the purposes of describing and defining the present invention, carbonless coatings comprise any imaging interface or coating that does not require that a conventional carbon sheet be interposed between the layer to receive the original image and the layer to receive the duplicate image.

The adhesive 40 is configured to include a secondary reusable adhesive portion 48. Further, the adhesive 40 is configured such that an adhesive void 46 is positioned in registration with the CF coating 58 and the CB coating 57. In this manner, the adhesive 40 will not interfere with creation of the duplicate image 56. The secondary reusable adhesive portion 48 is arranged about a periphery of the peel-out package label 50 and the adhesive void 46 is at least partially bounded by the secondary reusable adhesive portion 48. The liner ply 30, the peel-out package label 50, and the secondary reusable adhesive portion 48 are configured such that, following release of the peel-out package label 50 from the liner ply 30, the secondary reusable adhesive portion 48 releases substantially cleanly from the liner ply 30 and retains its properties of adhesion. For the purposes of defining and describing the present invention, it is noted that reference to portions in registration is not limited to perfect or substantially perfect alignment. Rather, the portions in registration must merely include respective aligned portions.

The peel-out package label 50 includes printed indicia 55 instructing a user of the shipment form 10 to remove the peel-out package label 50 from the shipment form 10 and adhere the peel-out package label 50 to a package, e.g., "Peel Here—Place Near Shipping Label."

The shipment form 10 also comprises a peel-out signature label 60 formed in the face sheet 20. The peel-out signature label 60 defines an upper signature label surface 61 and a lower signature label surface 62. The upper signature label surface 61 is substantially co-planar with the upper face sheet surface 21. The lower signature label surface 62 is substantially co-planar with the lower face sheet surface 22. The signature label 60 is configured to permit a user of the shipment form 10 to present an authorizing signature on the upper signature label surface 61. The upper face sheet surface 22 includes a first set of printed indicia 63 arranged to enable a user of the shipment form 10 to indicate that the authorizing signature corresponds to an authorization to deliver a package and a second set of printed indicia 64 arranged to enable a user of the shipment form to indicate that the authorizing signature corresponds to an authorization to pick up a package. Adhesive on the lower signature label surface 62 is configured to include a reusable adhesive portion 66 thereon and the liner ply 30, the peel-out signature label 60, and the reusable adhesive portion 66 are configured such that, following release of the peel-out signature label 60 from the liner ply 30, the reusable adhesive portion 66 releases substantially cleanly from the liner ply 30 and retains its properties of adhesion.

Having described the invention in detail and by reference to preferred embodiments thereof, it will be apparent that modifications and variations are possible without departing from the scope of the invention defined in the appended claims.

What is claimed is:

1. A shipment form comprising a face sheet, a liner ply, and an adhesive interposed between said face sheet and said liner ply, wherein:

said face sheet includes printed indicia for indicating an attempted delivery;

said adhesive includes a laminating adhesive portion and a reusable adhesive portion;

said liner ply defines a single sheet including a releasable liner ply portion and a laminated liner ply portion;

said releasable liner ply portion is configured to releasably adhere to said reusable adhesive portion;

said reusable adhesive portion and said releasable liner ply portion are configured such that said reusable adhesive portion retains its properties of adhesion following release of said releasable liner ply portion therefrom; and said laminated liner ply portion is configured to adhere to said laminating adhesive portion with an adhesion strength substantially greater than an adhesion strength of said releasable liner ply portion to said reusable adhesive portion, whereby said laminated liner ply portion and said laminating adhesive portion tend to remain adhered to each other upon separation of said releasable liner ply portion from said reusable adhesive portion, such that, upon said separation, said releasable liner ply portion remains adjoined to said laminated liner ply portion but permits adhesion of said reusable adhesive portion of said form to a mounting surface.

2. A shipment form as claimed in claim 1 wherein said reusable adhesive portion is arranged to define an adhesion surface that is capable of supporting the weight of said shipment form when secured to a substantially vertical mounting surface.

3. A shipment form as claimed in claim 1 wherein said liner ply is structurally altered to define a bendable portion positioned proximate a boundary defined between said releasable liner ply portion and said laminated liner ply portion.

4. A shipment form as claimed in claim 3 wherein said bendable portion comprises a perforation provided in said liner ply.

5. A shipment form as claimed in claim 4 wherein said perforation is offset from a boundary between said releasable liner ply portion and said laminated liner ply portion.

6. A shipment form as claimed in claim 1 wherein said face sheet, said adhesive, and said releasable liner ply portion include respective cut-out portions formed therein, wherein said respective cut-out portions are arranged to define a form hanging aperture.

7. A shipment form as claimed in claim 6 further comprising a die cut extending entirely through the cross section of said form from a side edge of said form to said form hanging aperture.

8. A shipment form as claimed in claim 1 wherein said form is configured to define a peel back tab portion in said liner ply.

9. A shipment form as claimed in claim 1 wherein said releasable liner ply portion and said laminated liner ply portion define a continuous planar surface of said liner ply.

10. A shipment form as claimed in claim 1 wherein said reusable adhesive portion and said laminating adhesive portion are comprised of a common adhesive composition.

11. A shipment form as claimed in claim 1 wherein said reusable adhesive portion and said laminating adhesive portion are defined by a single continuous adhesive layer.

12. A shipment form as claimed in claim 1 wherein said liner ply and said adhesive extend substantially the entire length of said face sheet.

13. A shipment form as claimed in claim 1 wherein said shipment form is arranged to define first and second continuous external surfaces, wherein said first continuous external surface is defined by substantially all of said face sheet, and wherein said second continuous external surface is defined by substantially all of said liner ply.

14. A shipment form comprising a face sheet, a liner ply, an adhesive interposed between said face sheet and said liner ply, and a peel-out package label formed in said face sheet, wherein:

said face sheet defines an upper face sheet surface and a lower face sheet surface;

said liner ply defines an upper liner ply surface and a lower liner ply surface;

said peel-out package label defines an upper package label surface and a lower package label surface;

said upper package label surface is substantially co-planar with said upper face sheet surface;

said lower package label surface is substantially co-planar with said lower face sheet surface;

said peel-out package label includes printed indicia on said upper package label surface for indicating an attempted delivery;

said lower package label surface includes a CB solution coated thereon;

said upper liner ply surface includes a CF solution coated thereon;

said CF coating on said upper liner ply surface is positioned in registration with said CB coating on said lower package label surface;

said adhesive is configured to include an adhesive void positioned in registration with said CF coating and said CB coating and a secondary reusable adhesive portion; and said liner ply, said peel-out package label, and said secondary reusable adhesive portion are configured such that, following release of said peel-out package label from said liner ply, said secondary reusable adhesive portion releases substantially cleanly from said liner ply and retains its properties of adhesion.

15. A shipment form as claimed in claim 14 wherein said secondary reusable adhesive portion is arranged about a periphery of said peel-out package label and said adhesive void is at least partially bounded by said secondary reusable adhesive portion.

16. A shipment form as claimed in claim 14 wherein said peel-out package label includes printed indicia instructing a user of said shipment form to remove said peel-out package label from said shipment form and adhere said peel-out package label to a package.

17. A shipment form as claimed in claim 14 wherein said adhesive void, said CF coating, and said CB coating are configured to:

permit a user of said shipment form to indicate on said upper peel-out package label surface conditions of an attempted delivery; and enable simultaneous creation of a duplicate image of said attempted delivery conditions on said upper liner ply surface.

18. A shipment form as claimed in claim 14 wherein said upper face sheet surface defines a front side of said shipment form and said lower liner ply surface defines a back side of said shipment form.

19. A shipment form comprising a face sheet, a liner ply, an adhesive interposed between said face sheet and said liner ply, and a peel-out signature label formed in said face sheet, wherein:

said face sheet defines an upper face sheet surface and a lower face sheet surface;

said liner ply defines an upper liner ply surface and a lower liner ply surface;

said peel-out signature label defines an upper signature label surface and a lower signature label surface;

said upper signature label surface is substantially co-planar with said upper face sheet surface;

said lower signature label surface is substantially co-planar with said lower face sheet surface;

said signature label is configured to permit a user of said shipment form to present an authorizing signature on said upper signature label surface;

said upper face sheet surface includes a first set of printed indicia arranged to enable a user of said shipment form to indicate that said authorizing signature corresponds to an authorization to deliver a package;

said upper face sheet surface includes a second set of printed indicia arranged to enable a user of said shipment form to indicate that said authorizing signature corresponds to an authorization to pick up a package;

said adhesive is configured to include a signature label reusable adhesive portion; and said liner ply, said peel-out signature label, and said signature label reusable adhesive portion are configured such that, following release of said peel-out signature label from said liner ply, said signature label reusable adhesive portion releases substantially cleanly from said liner ply and retains its properties of adhesion.

20. A shipment form as claimed in claim 19 wherein said adhesive portion covers substantially all of said lower signature label surface.

21. A shipment form as claimed in claim 19 wherein said upper face sheet surface defines a front side of said shipment form and said lower liner ply surface defines a back side of said shipment form.

* * * * *